United States Patent [19]

Clegg

[11] Patent Number: 4,807,131

[45] Date of Patent: Feb. 21, 1989

[54] GRADING SYSTEM

[75] Inventor: Philip M. Clegg, San Juan Capistrano, Calif.

[73] Assignee: Clegg Engineering, Inc., Orange, Calif.

[21] Appl. No.: 43,306

[22] Filed: Apr. 28, 1987

[51] Int. Cl.[4] ..... E02F 3/76

[52] U.S. Cl. ..... 364/424.01; 37/DIG. 1; 37/DIG. 20; 172/4.5

[58] Field of Search ..... 364/424, 424.01; 356/356, 4; 37/129, DIG. 19, DIG. 1, DIG. 20; 172/4, 4.5

[56] References Cited

U.S. PATENT DOCUMENTS

| | | | |
|---|---|---|---|
| 4,162,708 | 7/1979 | Johnson | 37/DIG. 20 |
| 4,244,123 | 1/1981 | Lazure et al. | 37/193 |
| 4,273,196 | 6/1981 | Etsusaki et al. | 172/4.5 |
| 4,299,290 | 11/1981 | Nunes, Jr. | 172/4.5 |
| 4,402,368 | 9/1983 | Moberly | 172/4.5 |
| 4,413,684 | 11/1983 | Duncklee | 172/4.5 |
| 4,537,259 | 8/1985 | Funabashi et al. | 172/4.5 |
| 4,677,555 | 6/1987 | Goyet | 364/424 |
| 4,700,301 | 10/1987 | Dyke | 364/424 |

*Primary Examiner*—Parshotam S. Lall
*Assistant Examiner*—Thomas G. Black
*Attorney, Agent, or Firm*—Grant L. Hubbard

[57] ABSTRACT

A fully automated earthgrading machine and system is disclosed.

40 Claims, 3 Drawing Sheets

GRADING SYSTEM

FIELD OF THE INVENTION

This invention relates to earth grading systems and, more particularly, to a system for accurately grading a tract of land using laser reference signals, stored data signals, and electronic control and display systems.

BACKGROUND OF THE INVENTION

The advent of heavy-duty, high volume earth moving and grading equipment has greatly increased the efficiency of earth grading operations involved in the construction of highways and in the preparation of tracts of land for building or farming, or for other uses. The introduction of the laser into grading operations dramatically simplified the grading of flat parcels of land and significantly increased the accuracy with which the grading can be accomplished. Not withstanding these great advances, however, the actual work of grading land still requires a great deal of manual labor and site surveying and pre-preparation.

The approach to preparing a tract for grading and for grading the tract has, with a few significant exceptions, remained unchanged for several decades. Generally speaking, the following steps are used in most grading operations. Once the tract perimeter has been defined by traditional surveying method, and a determination as to the ultimately desired utilization of the tract has been made, an engineering study is undertaken to determine the feasibility of preparing the tract for the desired utilization and to define the ultimate, graded configuration of the tract. (It should be noted that in the present discussion, reference will be made to a tract of land and the invention described hereinafter will be described with reference to the preparation of a tract of land for residential use. It will be understood, however, that the term "tract" is of general application, and would refer to any tract or area of land which requires site preparation. This would include the construction of freeways, building pads, fields for agricultural use, runways for airport use, construction of dams or other conservation projects, etc.)

The engineering phase of site preparation results in plans and specifications which define the configuration of the site in its desired final form. The plans and specifications would, typically, comprise one or more tract plans which are, in effect, a view of the site from directly overhead, i.e., a plan view, and one or more elevational views, if significant elevational structure is involved, taken along vertical planes which intersect the planned view at various desired locations. These plans define the ultimate, or, as used herein, the "target" configuration of the site by means of a number of individual points, each of which is defined by northing and easting coordinates, including the elevational and slope defining data. These coordinates define each location on the tract in terms which correspond, conceptually with the lateral and longitudinal location of the point. By a separate set of specifications an elevational index assigns to each coordinate an elevation and the cross slope of the grade at that point. It is common practice now, to define the tract in terms of "northing" and "easting" points, each of which northing and easting points may be assigned a corresponding spot elevation. Elevations are typically identified by spot elevations, contour lines and/or grade break lines. The northing and easting of a given point is defined as the distance north and the distance east from a reference point which may be located in the southwest corner of the tract being graded. The elevational point may be defined in absolute terms, i.e., distance above sea level, or in relative terms giving an elevation above or below a given reference point. The same reference point may be used from which all northing and easting points and all elevational points are measured. Drawings may also be prepared which show in perspective or isometrically the ultimate configuration of the tract. Modern electronic data processing techniques and sophisticated programs can generate perspective and isometric views of a tract from the northing, easting and elevational data provided in the engineering study. The engineering study also provides a great deal of additional information which is not particularly germane to the present invention. For example, the engineering study will result in information as to the amount of earth which must be moved, the amount of fill which must be accomplished, whether or not earth will need to be moved onto the tract to accomplish sufficient filling or removed from the tract, etc. These data are, of course, very important in obtaining competitive bids and in projecting the costs of a given project.

Thus, from the engineering study, one skilled in reading engineering drawings and tract specifications, can determine from the drawings and the specifications what the tract configuration is before the project begins and what the tract configuration will be when the grading is completed. All this, however, is simply on paper and there yet remains the far greater task of actually preparing this site to conform to the drawings and specifications prepared in the engineering study. Traditionally, a survey crew would take the engineering documentation to the site and mark the site with stakes which convey to the grading equipment operators the instructions for grading the tract. By marks on the stakes, which are readable to those skilled in operating grading equipment, the depth of a cut or a fill, and the angle of slopes, etc., are defined. Unless the grading is unusually simple, however, it is insufficient for actual grading to proceed simply to mark by survey stakes the individual northings and eastings and to indicate the depth of the cut to be made or the fill to be made in particular locations. This marking would probably be sufficient for a large, flat tract of land, but would not be sufficient for grading of hilly terrain, or where multiple elevations or slopes are involved.

The survey crew, in nearly all grading projects of significant complexity, must place a great many stakes between the predetermined reference points to guide the grading machine operator. Typically, these stakes would be placed fairly close together, perhaps as close as two or three feet or even closer, where different slope, elevations, or curves intersect, and at least every ten to fifteen feet if there is any significant curvature or variation from a flat horizontal plane. The placement of these stakes is a very time consuming and expensive operation.

Even when all of the intermediate stakes have been placed, there remains a great challenge in actually producing a grade in accordance with the definition provided by the stakes. Frequently, the stakes are moved during the grading operation, perhaps by accidental contact by the grading blade or other grading tools, by being run over by the grading machine or other equipment, or by movement of the earth adjacent to the stake resulting in instability or movement of the stake. While the practice is frowned upon by civil engineers, there remains, nevertheless, a very common practice of simply driving the stake back in the ground and estimating that it is in the right location and right elevation. This practice, by the grading crew, frequently results in errors in grading and the necessity to go back and regrade the tract or a portion of the tract. This procedure also nearly always requires that there be an additional individual who walks along beside the grading machine, uncovering the grading stakes and assisting the operator to position the grading tool at the proper elevation with respect to the grading stake. Thus, in addition to the grading machine operator, an assistant i required essentially on a full-time basis.

It will be apparent from the procedure just described that the present procedures for grading a tract of land are expensive and often lead to erroneous grading which either requires correction or by regrading the tract, or present problems during or after construction.

Techniques for grading are well known and are described in many test and treatises. References made to the following simply as exemplary of the treatises which describe various grading and excavating equipment and methods:

EXCAVATING & GRADING HANDBOOK, Nick Capachi, Craftsman Book Co., 542 Stevens Ave., Solana Beach, Calif. 92075;

CONSTRUCTION PLANNING EQUIPMENT AND METHODS, Third Addition, R. L. Peurfoy, McGraw-Hill Book Co., New York, (1979), and EXCAVATION HANDBOOK, Horis K. Church, McGraw-Hill Book Co., New York, (1981).

There have been many efforts to automate various facets of the earth grading operation. For example, a device for automatic control of earth-moving machines is described in U.S. Pat. No. 3,009,271, Kuehne, et al., Nov. 21, 1961. Kuehne, et al. describes a method in which an analysis of the grading problem is made and recorded on precision cams or some similar method of presenting detailed information, punch cards for example. Range and azimuth information and elevational information are generated by a complex opticalmechanical system for indicating the depth the earth moving machine should make at a particular point. The Kuehne, et al. system relies upon an optical signal generator at a fixed geographic point, means for modulating the optical signal to include information relative to the cut to be made, and means for producing range and azimuth indicating signals which define the relative position of the optical radiating signal device and the earth moving machine. The distance and azimuth between the optical radiating device and the earth moving machine is the critical and controlling factor. In effect the Kuehne, et al. device was an optical direction finding and locator device which transmitted control information by means of a modulated optical system.

Another optical-mechanical system in which it is sought to overcome the difficulties in placing a large number of datum stakes as described, is disclosed in U.S. Pat. No. 3,046,681, Kutzler, July 31, 1962. The Kutzler system relies upon a pair of interacting optical radiation and receiving devices. In the Kutzler system, as in the Kuehne, et al. system, the range and azimuth relationships between the optical devices and the earth moving machine are the critical and controlling factors. Kutzler describes his apparatus in terms of means for establishing a reference data including a tri-planar reflecting device and means for selectively limiting the reflection of light thereon to define the location of the earth moving device with respect to the radiating devices.

Bourgeous, U.S. Pat. 3,126,653, Mar. 31, 1964, discloses a step point grade control device which uses an idler wheel and a measuring wheel to measure distance traveled and interrelates, in incremental steps, the distance traveled with suitably coded control tapes. The grading machine is provided with means driven by the measuring wheel which causes the control tape to move in proportion to the movement of the grading machine so that for particular points along the control tape, the machine occupies a corresponding point in the section of the road bed being graded. The Bourgeous system uses a rearward set of wheels which ride on the finished grade and serve to establish a reference plane utilized by the control apparatus to determine the depth and angle of cut and also serve as a surface on which the measuring wheel rotates freely so as to measure accurately the travel of the grading machine. The Bourgeous system is designed to make the final grading and the machine is controlled strictly by the tape which is driven by the measuring wheel. Bourgeous does indicate that it is possible to make different surveys and different tapes to make a multiple series of cut to ultimately obtain a finished grade. This requires, as pointed out by Bourgeous, that a second survey be made after the first effort at grading is made. The Bourgeous system, then, is a discrete step function system which has comparatively little flexibility and leaves few options for control by an operator. The stepping function of the Bourgeous system is a significant limitation on its utility in most grading operations. That limitation is overcome in the present invention. One important facet which is necessary to consider in the design and utilization of earth moving machinery is that there is required a considerable element of judgment on the part of the operator, especially during the initial grading phases. If the cut is too deep, the earth moving machine may simply stall, or ride over the earth, or deviate from its intended course. Except for the very final grading operation, it is, accordingly, impossible simply to define a course and direct the earth grading machine along that course, since it will usually be physically impossible for the earth grading machine to follow the prescribed course. Thus, it is essential that the operator be in control of the earth grading machine, except during the final grading passes, at which time it is possible to provide absolute control of the grading too.

Quite some years after the pioneering work of Townes in developing the laser, and with the industrialization of the laser, Studebaker, U.S. Pat. No. 3,494,426, Feb. 10, 1970, adapted the capabilities of laser control to earth grading equipment. Studebaker was able to obtain extremely accurate elevation control of the earth moving blade of a road grader over a wide working area by sweeping a laser beam periodically over the working area at a known elevation, thus establishing a reference plane of laser energy, then detecting the beam by suitable photoelectric devices carried on the vehicle, which are not interfered with by ambient light conditions, and then utilizing a signal generated by the photoelectric device to control the elevation of the blade. Devices of this type gained wide acceptance and are used in grading operations where high accuracy in obtaining a level tract or a uniform grade in the same plane are required. Studebaker found it important to maintain the mast in the vertical orientation regardless of the orientation of the earth moving machine.

Teach and Ramsey, U.S. Pat. No. 3,813,171, May 28, 1974, adapted the laser reference plane principal to earth trenching equipment and the like and provided a horizontal laser reference plane and a vertical laser reference plane to assure that, for example, a trench would be perpendicular to the plane of the earth, or at any desired angle.

Teach, U.S. Pat. No. 3,953,145, Apr. 27, 1976, further adapted an apparatus the laser reference beam principal in adapting an apparatus for controlling the elevation of a grading tool in a predetermined relationship to a fixed horizontal plane which is set by a laser beam which is periodically swept across the working area. The apparatus comprised a tape dispensing device carried by the machine and arranged to intermittently advance the tape past the tape reader. The tape carried two sets of indicia, one set indicating whenever a change in the height of the grading tool is required at a particular point and a second set of indicia indicating the distance between the points. A ground engaging wheel measured the travel of the machine and connected the tape dispensing device to advance the tape to the next set of indicia whenever the machine had traveled far enough to arrive at the next of the predetermined points. The Teach, U.S. Pat. No. 3,953,145, patent apparatus is similar to that of Bourgeous, U.S. Pat. No. 3,126,653, except that Teach utilizes the laser reference plane whereas Bourgeous used the optical range and azimuth system. As with Bourgeous, and the other prior art heretofore discussed, Teach would seem to be adequately adapted to making the final grading cut, or to laying pavement, which seems to be the principal application to which the Teach '145 invention is directed. These step function based systems are inadequate, however,in making preliminary cuts and in allowing the operator to exercise judgment in controlling the earth moving machine, as well as in providing ultimate control. The inability to control blade elevation along a continuous curve and the inability to control cross slope is a serious drawback of these and other prior art systems.

Johnson, U.S. Pat. No. 4,162,708, July 31, 1979, combined the rotating laser beam reference plane concept with a computer carried by the vehicle, operating under predetermined computer program to accurately control the grade in a given area. The specific disclosure of the Johnson '708 patent deals with a particular laser detector concept and construction. Johnson discloses, in rather broad and general terms, a computer controlled grading machine in which a computer receives signals indicative of the distance between a blade and a laser reference plane, the slope of the blade, the directions of steering of grading machine, a speed and distance sensor incorporated in the speedometer and odometer, and compares the actual position of the steering system with a preferred position defined by the computer program. The system has utility in the construction of highways, etc., which follow mathematically predictable courses. Other than the utilization of mathematically defined curves, etc., Johnson contains no disclosure as to any particular system of operation or system for carrying out a particular operation. With respect to the computer control of the earth grading equipment, Johnson discloses mechanisms for controlling the particular elements of the machine, but does not disclose an overall system capable of performing any functions other than the configuring of mathematically defined curves. Johnson speaks mostly in generalities and has little specific information regarding any particular computer controlled operation.

The present invention overcomes the difficulties described before, reducing manpower costs, providing the flexibility to grade the continuous curves and cross slopes of any configuration, and yet maintaining the judgmental control of a grading machine by the operator.

SUMMARY OF THE INVENTION

The present invention comprises, in combination and interconnected either electronically or through radiant energy as a system, a digital processor, an elevation signal generator for generating a digital signal which is a function of the elevation of the cutting blade of an earth mover relative to an elevation reference point, a position signal generator for generating a signal which is a function of the cutting blade relative to a location reference point, a data reference signal generator for generating a signal which is a function of the elevation and slope of the grade to be cut by the earth moving machine, a display connected to receive signals from the digital processor for displaying visual indicia which depict one or more index symbols, such as lines, points, or figures, which are a function of the elevation and/or slope to which a tract of land is to be graded, and one or more index symbols which are a function of the elevation and/or slope to which the tract of land is to be graded to at a predetermined position on the tract. The system preferably includes a blade angle signal generator for generating a signal which is a function of the slope or angle of tilt relative to a reference or horizontal of the cutting blade of the earth moving machine and a direction signal generator for generating a signal which is a function of the direction of travel at a given time of the earth moving machine. The system may also include a fixation signal generator for generating a signal which is a function of the actual elevation, tilt or position of the cutting blade or the direction of travel of the earth moving machine. The system may include means for automatically adjusting the cutting blade in response to an output signal from the digital data processor and means for displaying a tract plan which may also include means for displaying the position and/or direction of travel of the earth moving machine on the tract at a point in time.

The present invention comprises, in one aspect, an earth grading system which includes in combination one with another, a power driven earth grading machine, a laser beam generator, a laser beam detector carried on the grading machine, distance scaling means on the grading machine, direction identifying means on the grading machine, a position signal generator, data storage means which define a multiplicity of predetermined points to be graded, reference data signal generating means for deriving a data signal from the data storage means which defines the final graded configuration of the tract, elevation data signal generating means for deriving a data signal from the laser detector which defines the actual elevation of the grading tool, position and direction data signal generator means for deriving a data signal from the scaling means and the position and direction identifying means which defines the actual location and direction of travel of the grading tool, cross slope detecting means for deriving a signal which defines the cross slope of the grading tool, and comparator means for receiving the aforesaid data signals and deriving at least one output signal which defines the elevational and cross slope relationship of the grading tool relative to the target elevation and cross slope angle at the actual location of the grading tool.

The grading system may, optionally, comprise data entry means on the grading machine to permit the operator to enter data defining the actual location of the earth grading tool at various points, and means in the comparator for processing the actual location data along with the aforesaid data signals in deriving the output.

The data storage means may comprise means which defines the allowable elevational tolerance at predetermined points and the comparator comprises means for deriving an output signal relating the elevational tolerance to the actual elevation of the grading tool.

The system preferably comprises a video display screen, or other suitable display means, for receiving the output signal and displaying visual indicia on a scaled display depicting, according to a predetermined ratio, the target elevation, allowable elevations which are within tolerance, and the actual elevation of the grading tool at all points during the travel of the grading tool on the tract. The angle of the blade relative to the slope to be accomplished, along with tolerance indicia may also be displayed.

The distance scaling means may comprise a scaling wheel or, for greater accuracy, a pair of tandem scaling wheels mounted to the frame for tracking along the graded earth behind the grading tool from a predetermined northing and easting point on the tract to be graded, the comparator receiving a signal which is indicative of the least travel of the two scaling wheels along any corresponding portion of the tract, thus obviating errors in scaling which may result from slippages, holes, etc.

Location or position of the earth mover may be ascertained by any of several techniques, from which a position signal is derived and encoded and fed into the digital comparator unit along with the other available data to produce two signals, one signal defining the elevation and slope transverse of the earth moving machine which is to be attained at the location of the moving machine on the tract undergoing grading and the other signal indicating the actual elevation and slope of the blade at that location on the tract. These two signals are compared and appropriate adjustments of the depth and slope of the cut are made. These adjustments may be made fully automatically, or alternatively, the nature and magnitude of the adjustment is derived by the operator by comparison of two indicia, such as, for example, two lines on a video display, and the changes manually or semi-automatically implemented.

Distance of travel signals may be generated or derived from any of a number of instruments. Scaler wheels have been described as one example of the source of such a signal. Electronic distance measuring devices may be used by, for example, triangulating with two such devices and calculating the distance from any given point to the actual location of the earth mover, either periodically or substantially continuously by repeating the measurement and calculation every second or less or every few seconds. Inertial sensing instruments and gyroscopic instruments produce a signal which is proportional to movement in one, two or three directions, or in all directions, from any point to any other point and may be used within the sense and concept of this invention to produce distance and/or location and/or elevation and/or direction of travel signals. For example, a high precision gyroscope may be used as the sole signal source of signals which define distance of travel from a given point, the direction or angle from a given point in a coordinate system, elevation relative to a given point, and, by point and angle comparisons, the direction of travel to the locational point of the earth moving machine. Generally speaking, however, it is desirable to use two or three types of signal generating devices, taking advantage of the particular precision and flexibility of each. Distance from reference points may be determined, for example, using electronic distance measuring devices which rely upon infrared or other radiation reflection and may use doppler effect to measure velocity as well. Absolute and relative locational signals my be derived using celestial satellite signals, either reflected from or generated on satellites. The present technology of these systems requires that additional verification signals or data be used, but the precision of these satellite location and movement signal detecting systems is improving to the point where sufficiently high precision for many applications exists and will exist in the future. Ground wave, infrared, radar, ultraviolet and other transmission and detection signals and relative motion signal generators may also be used within the scope of the present invention.

The invention also encompasses a method for grading comprising, in combination, most or all of the following steps. Target planar coordinate data, the northing and easting points of the final desired configuration, for a multiplicity of points on the tract are derived from the grading plan. Target elevational data, the final desired elevations, for each of the northing and easting coordinate points are derived from the engineering plans. The northing and easting coordinates and the elevation for a multiplicity of points are encoded for processing by an electronic data processing comparator. The encoded data are recorded on a suitable recording media, a computer diskette, for example. The actual coordinate position of the earth grading machine, on the tract to be graded, is determined by reference to survey stakes, or using any of the instruments or techniques mentioned or equivalents thereof, and the actual positional data are encoded and are entered into a comparator electronic data processing unit. During travel of the earth moving machine, position and direction of travel are identified by the position detector and the direction identifier. The encoded data are introduced into the comparator, thus determining at all times as a continuum of data, the actual coordinate position of the earth grading machine, with reference to its initial position, and the direction of travel. The cutting angle of the blade is determined and compared with the angle of cut which is required at the particular coordinate position. The distance can be scaled, using a relatively simple but reliable approach, by the distance scaling means and the scaled distance encoded and the encoded data are introduced into the comparator data processor. At the same time, during operation of the earth grading machine, the actual elevational position of the earth grading tool, typically the grader blade, is derived. A reliable means for deriving this signal is the laser beacon and a laser beam detector, which detects a laser beam having a predetermined plane or pattern, the plane or pattern of the laser having a known relationship to the target plan for the tract. The actual elevational data are encoded and introduced into the comparator data processing unit. The comparator data processing unit compares the target data, that is the data which defines the ultimate, graded configuration of the tract, at the particular point where the grading machine is located, using the actual coordinate positional data as the definition of the location of the grading machine. The target elevation is compared with the actual elevation of the grading tool. The target cross slope is compared with the angle of the cross slope angle of the grading tool.

In the preferred embodiment, tolerance elevation and cross slope angle data are generated for the tract at the various locations are also recorded. By displaying a tolerance indicia for each locational point, the operator knows when the cut being made is producing a grade which is with elevation and/or slope tolerance. The comparator generates an output signal or series of signals which define in a known, quantitative relationship, the target elevation and slope, the actual elevation of the grading blade, and the tolerance allowed in the elevation and/or slope at the particular point. These data may be used directly through suitable servo mechanisms to automatically control the elevation and cross slope angle of the blade.

A significant advantage of the invention is in the processes described in connection with the step of displaying to the operator by a visual display means, e.g. a video screen, one or more indicia, e.g. a line or lines on the screen, indicating the target elevation and, if desired, slope, and other indicia, e.g. a second line or lines on the screen, indicating the actual elevation at either end or in the center of the grading blade and/or the angle of tilt or cut of the blade, depending upon the reference point from which one chooses to measure cross slope angle orientation of the blade, and preferably also displaying another indicia, e.g. a third set of lines on the vertical scale on the screen, showing the allowable tolerance of the elevation and/or slope. Means are provided for setting the maximum permissible tolerance and controlling the cut to within the tolerance or warning the operator when the tolerance is or is about to be exceeded. These lines may or may not indicate the cross slope angle desired and the blade angle, according to the particular requirements of the project.

In the preferred embodiment, the indicia comprise a line on a video display indicating the target elevation or the target elevation and cross slope angle at the position occupied by the grading blade at each point in time and at each location, as the grader moves, a second line indicating the actual elevation or the actual elevation and cross slope angle of the grading blade, and a vertical scale on the video screen, quantitatively relating the target elevation, or target elevation and cross slope angle, with the actual elevation, or the actual elevation and cross slope angle, such that the operator, viewing the video display will have an instantaneous, visual and quantitative indication of the relationship of the target elevation with the actual elevation.

In the preferred embodiment, a third set of lines or scale is displayed on the video display indicating the tolerance which is allowable at the particular point in the grading. The operator thus has an instantaneous, quantitative indication not only of the target elevation or target elevation and cross slope angle but of the actual elevation or elevation and cross slope angle, and the relationship of both to the tolerance allowable at the particular point. This enables the operator to exercise his judgment, without the need of delaying calculations, etc., in controlling the depth of cut of the grading tool, its cross slope angle of tilt, etc. Simply by viewing the screen, he can adjust the grading tool such that, in his judgment, the grading tool corresponds to the target elevation or, if this is not possible because of the depth of cut required or the terrain, adjusting the grading tool to obtain the maximum cut of which the grading machine is capable in approaching the target elevation.

One feature of the invention which is of importance in most applications, is that the ultimate decision as to the travel, depth of cut, etc., of the grading machine remains within the judgment of the operator, and yet permits the total computer automation of the data necessary to enable the operator to determine instantaneously, and quantitatively, from a visual display all the information he needs to exercise his best judgment, instantaneously and without delays incident to reading stakes, calculating, etc.

In addition to these steps, it is contemplated within the scope of the invention that the same video display unit, using a split screen technique, or a separate video display screen display a plan view of a portion or all of the tract to be graded, and identify on that tract the actual location of the grading machine.

These and other features of the system and the method of this invention will become apparent from the drawings and from the description which follow.

DESCRIPTION OF THE PREFERRED EMBODIMENT

Figure 1:
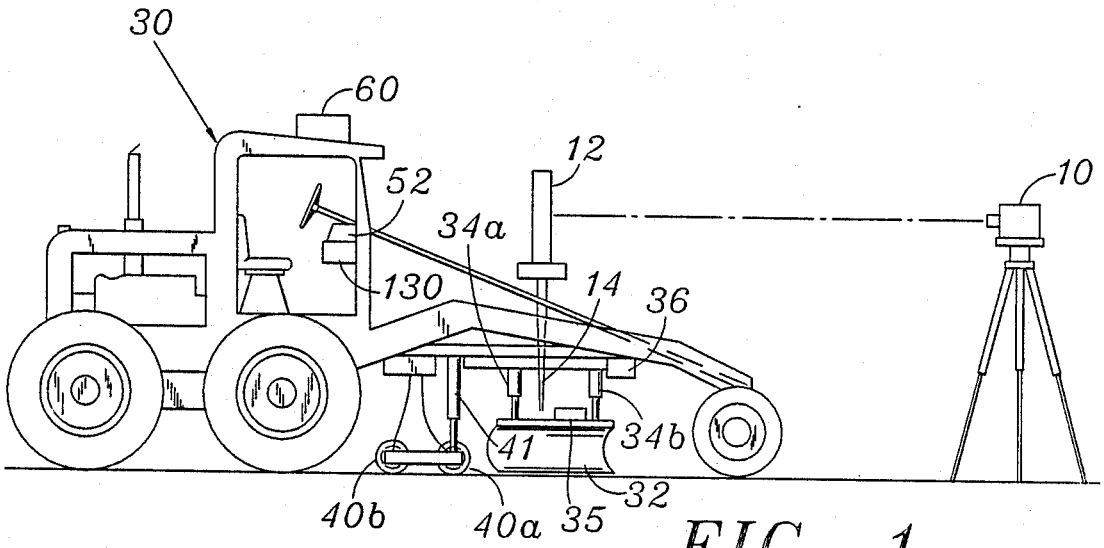
FIG. 1 is a schematic depiction of an earth grading machine which comprises one of the components of the system of this invention, including a depiction of a laser reference beam generator and laser reference beam receiver, the latter being mounted on the earth grading machine.
Figure 2:
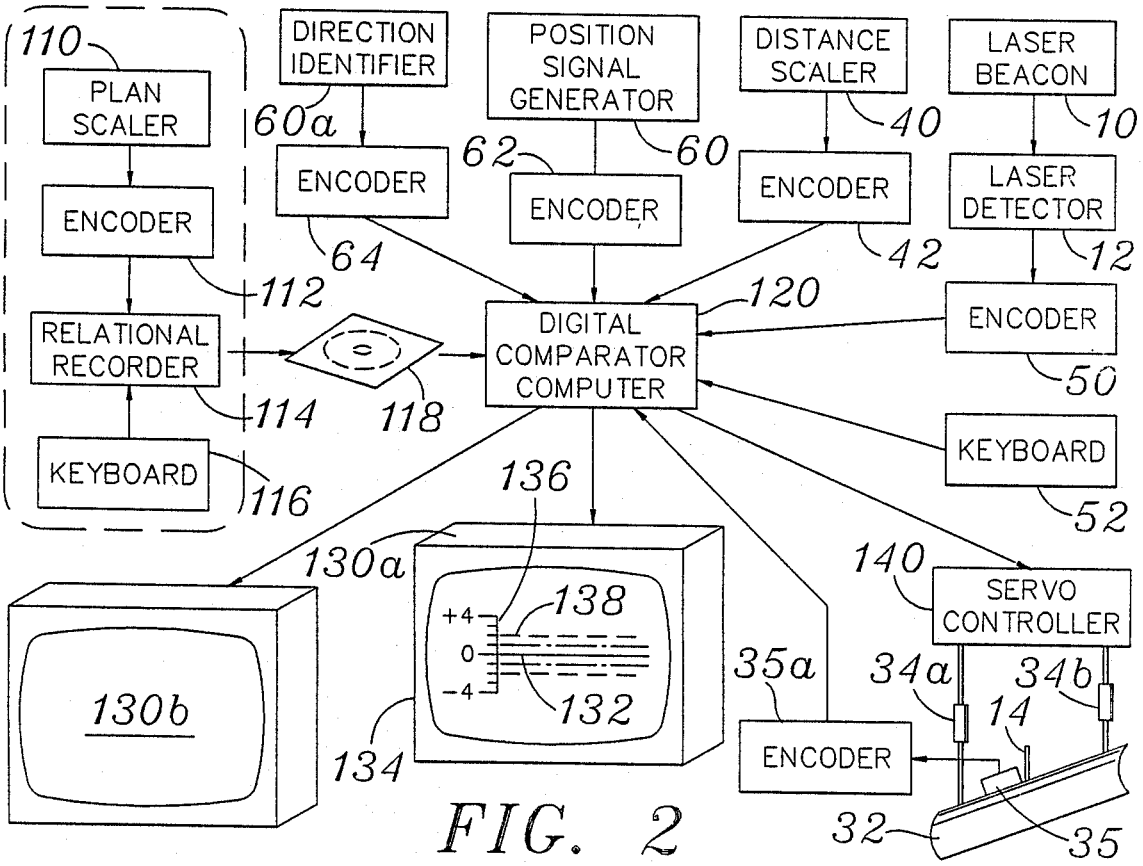
FIG. 2 depicts the combinational and interconnectional features of system according to this invention.

The major components of the system of this invention are depicted or represented schematically in FIGS. 1 and 2, to which reference is now made with particular reference being made first to FIG. 1.

One illustrative system, shown in FIG. 1, comprises a laser beam generator 10 for projecting a laser beam in a predetermined pattern relative to the earth to be graded. The pattern, typically, is in the form of a rotating beam which defines a plane at a given elevation. The beam may be programmed, however, in any desired way. A laser detector or receiver 12 is carried on the grading machine 30 for receiving the laser beam, and for generating an elevation signal which defines the elevation of the blade relative to a predetermined point on or adjacent the tract. As will be discussed in more detail, other elevation signal generating means may also be used. The laser detector may be mounted on the earth mover in any desired manner. For example, it may be mounted on one end or the center of the blade, or a detector may be mounted on both ends of the blade in which case two signals are generated and the slope and elevation is derived from these two signals. The laser detector may also be mounted on the frame. All that is necessary is that there be a known relationship between the location of the laser detector and the cutting edge of the blade, which relationship may be constant or variable, so long as it is known at any given time. In this exemplary embodiment of the invention, the laser detector is interconnected by any desired means, such as a shaft 14 to the grading blade 32 and, thereby, measures the elevation of the grading blade 32. As will be described, the laser detector generates a signal indicative of the elevation of the grading tool, the blade 32 as shown in FIG. 1. The grading tool is mounted on the earth moving machine and is provided with tilt and elevation controls 34, and a tilt or cross slope angle indicator 35 which measures the cross slope angle of the blade relative to horizontal, and also with angular orientation controls 36. These control mechanism are, in themselves, conventional hydraulic rams, gear mechanism and other well-known electrical, electro-mechanical and mechanical devices; however, the interconnection, interaction and interrelationship of such devices is novel and, working together, accomplish results not previously accomplished.

In addition to the conventional equipment, the earth grading machine may optionally have mounted thereon at least one and preferably a pair of scaling wheels **40*a* and 40*b*, which comprise distance scaling means. The exemplary tandem scaling wheels are mounted on the frame by any suitable means, such as a resilient mount 41 for tracking on the graded earth behind the grading tool for accurately scaling the distance of the grading tool from a predetermined northing and easting point on the tract to be graded. A single wheel may also be used, but is much less desirable. The scaling wheels 40*a* and 40*b* are connected to an encoder indicated generally at 42 for encoding the distance scaled into a digital or other signal which may be processed within the system to be described. The earth moving machine also has mounted thereon a number of other components, as shown in FIG. 2, including a keyboard 52 and a video display 130, which are described hereinafter. Other components of the system are now described with reference to FIG. 2**.

The processing system of the invention is shown schematically in FIG. 2 and comprises the laser beacon 10 and detector 12, which are shown schematically in FIG. 2, and an encoder 50. An optional data input device, such as keyboard 52, is connected to the system to permit entry of correctional data or modifications which may be made on the job, or to provided reference data or values for fixing or correcting the locational data relative to the earth moving machine. The cross slope of the cut is determined by data input into the system from engineering plans and is controlled by the servo controller 140 which controls both elevation and cross slope angle through a pair of hydraulic rams **34*a* and 34*b*, the actual cross slope angle at which the grading blade is cutting being measured by an cross-slope detector 35, the output of which is encoded in digital form in encoder 35*a*, or simply reported in digital form, to the digital comparator computer or central processing unit for the system, shown at 120**. Again, each of these instruments and mechanisms per se are known, and means other than those specifically disclosed may be considered as equivalents.

The exemplary distance scaler, as previously described, is also shown on FIG. 2 as is the encoder 42.

Also shown in FIG. 1, and schematically depicted in FIG. 2, is a position defining system, which, in the embodiment depicted, comprises a position or location signal generator 60 which generates a signal which defines the location earth moving machine on the tract or relative to a point bearing a known or ascertainable locational relationship to the tract. One or more electronic distance measuring (EDM) instruments, or other distance and/or angle measuring instruments, such as, for example, gyroscopes or inertial detectors, may be used. The positional data are fed into an encoder 62. A direction signal generator **60*a* may be included in or added to the location signal generator to defined the direction of travel of the earth mover at any moment in time. The direction signal data are fed into encoder 64. The output of encoders 62 and 64 are fed into the digital comparator 120**. While separate location and direction systems are shown, for clarity of illustration and to teach the concept, the functions of these two systems can be combined into one without departing from the invention.

it is possible, now using the invention as described, to derive from the engineering study of the tract the paths to be followed from location to location by the grader, to define those paths and to either automatically control the location and path of travel or to display indicia to enable the operator to follow the predetermined path of travel.

FIG. 2 also depicts an input system which is not central or necessary to the present invention, and which is described simply as illustrative of the ease with which the necessary data are input into the inventive system as described here. Separate from and not carried by the earth moving equipment, typically, although it could be so carried, is a plan scaler or digitizer, comprising a small instrument which travels over the engineering plan and scales the distance between points. It is to be clearly understood, however, that any manner of introducing reference data may be used, such as, for example, conventional key punching, optical scanning, algorithm output, etc. However, for clarity of concept reference will be made to a scaler. This, in the example, the plan scaler 110 is connected to an encoder 112 which generates a digital or other desired signal carrying the necessary reference information which, in turn, is integral with or connected to a relational recorder 114 which also receives input from a keyboard 116 and produces a recording of the data generated from the plan scaler and the keyboard. The plan scaler 110 and encoder 112, along with relational recorded 114, and keyboard 116, constitute mans for producing a data signal defining a multiplicity of predetermined points on the tract to be graded, by the northing and the easting of the point, and by the target elevation of each such point. These data are stored on the data storage means 118. The data storage means 118 is typically in the form of a magnetic recording diskette, frequently referred to as a "floppy" diskette.

It is emphasized that the encoding of elevational, cross slope angular, locational and distance data may be accomplished manually, i.e. by simply punching in the data using standard keypunch techniques, by a scaler or digitizer, or in any other manner, and the encoded data may be stored on tapes, floppy disks, or even stored in a CPU at a fixed station and transmitted to the grader as needed.

Central to the system of this invention is a digital comparator computer capable of processing the positional, elevational, etc., data and deriving a signal and, preferably at least one difference signal to be displayed or with which to control a wholly or partially automatic or manual grading machine. The digital comparator computer 120, which may be a programed small industrial or expanded personal computer (PC) such as is manufactured, for example, by IBM, receives a signal from the data storage means 118 defining a multiplicity of predetermined points on the tract to be graded by the northing and by the easting of that point and the relation between such points by the target elevation of each such point. Cross slope data may also be entered for each point or calculated by the comparator computer based upon the elevational relationship of the various points. In the preferred form, the digital comparator computer also receives signals from the encoder 35*a* which defines the cross slope angle at which the grading blade is cutting the cross slope, and from 50 which defines the reference elevation of the earth grading tool (which may be any point on the blade, typically either end or the middle), as determined by the laser beacon and laser detector. Additionally, the digital comparator computer 120 receives a signal from the encoder 42 which defines the distance derived by the distance scaler 40. If desired, the digital comparator computer can also receive a position identifier signal from the encoder 62 and a direction identifier signal from encoder 64 defining location and direction of travel of the earth grading machine.

Either, as an integral part of the digital comparator computer or by subsidiary data processing modules, the system includes reference data signal generating means for deriving a data signal from the data storage means 118 which defines the desired final graded configuration of a continuous portion of the tract by a continuum computed with reference to at least one predetermined point, all locations on the continuum being defined as to target elevations and cross slope grading angles. Elevation data signal generating means are also included in or connected with the digital comparator computer for deriving a data signal from the laser detector 12 which defines the actual elevation of the grader blade. Cross slope angle signal generating means 35 are also encoded, if necessary, and introduced into the digital comparator computer where the actual cross slope being cut is compared with the target cross slope, enabling corrections to be made automatically or manually.

Figure 3:
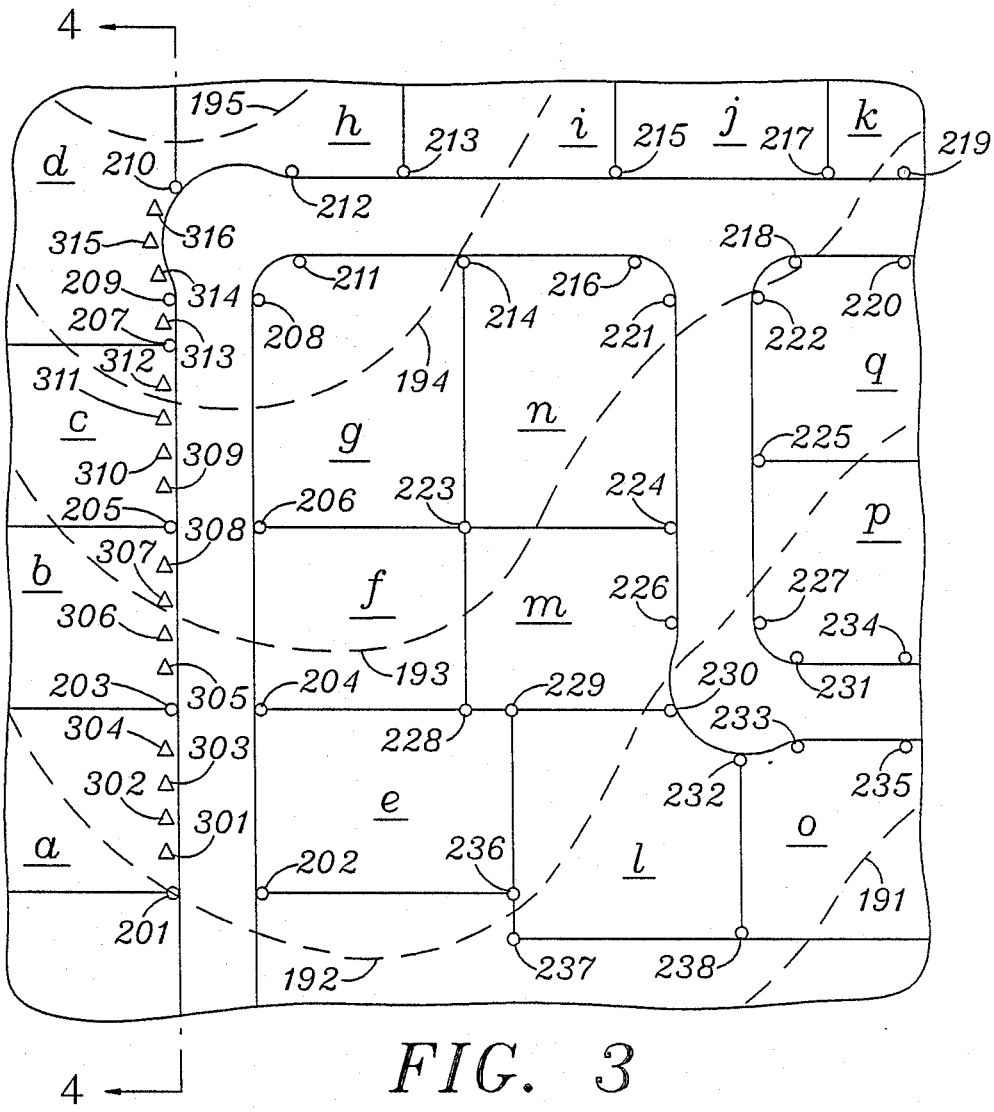
FIG. 3 is a plan view of a building site tract, of a type which may be graded according to the principals of this invention.
Figure 4:
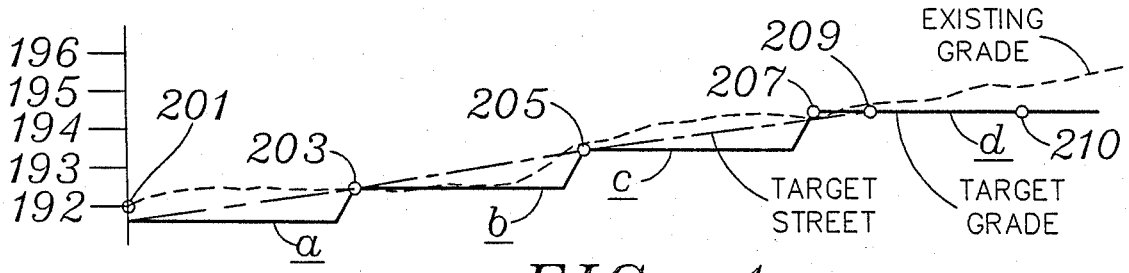
FIG. 4 is a view of an elevation of the building site tract of FIG. 3, taken substantially along the lines 4—4, depicting some features of the grading which may be accomplished according to the principles of this invention.

Reference is made to FIGS. 3 and 4 as an aid in understanding the method of using the system of this invention. FIG. 3 is a plan view of a grading site showing the existing contour and the target configuration. FIG. 4 is a vertical profile of a portion of the tract of FIG. 3 taken along the street line indicated by the lines 4—4 of FIG. 3. The existing profile of the tract, before grading, is indicated by the contour lines showing elevations at 191, 192, 193, 194, and 195. These contour lines are, simply for illustration purposes, suggestive of a contour ranging from an elevation of 191 feet to 195 feet from the lower right to upper left corner of the tract. Overlaying the contour lines are building pad definitions, defining a number of building pads identified by the letters a through o. These building pads are defined by northing and easting points identified by numerals 201 through 238. These northing and easting points define the periphery of the particular building pads. Additional northing and easting points may, of course, be included as desired, these northing and easting points simply be illustrative of the type of points which would be utilized in the process of this invention.

Referring for the moment to FIG. 4, one will identify the starting profile by the solid, curved line upon which northing and easting points 201 through 210 appear. These would correspond to stakes driven into the existing profile to define the corners of the particular tracts a through d, indicated by the straight dashed lines of FIG. 4, which define the target profile of the building pads, in the ultimate target configuration. The profile of the street running adjacent the building pads is indicated by the dashed line which is a smooth curve running typically intermediate the elevations of the various building pads. The engineering of the tract would result in a plan drawing of the tract which would include the information shown on FIG. 3, including the specific northing and easting of each of the points 201 through 238. The specifications resulting from the engineering analysis would include the elevation at each of these northing and easting points. Other information would also be included, but the foregoing is sufficient for the present discussion.

Preliminary to carrying out the process of this invention is to produce a readable record of the data specifying the northing, the easting and the elevation of each of the points 201 through 238. The cross slope angle for each of these points may also be defined. This may done in any manner, for example, by using the plan scaler 110, or digitizer or both, reference now being made occasionally to FIG. 2. The encoder 112, the relational recorder 114 and the keyboard 116, are used as described to produce, typically, a computer diskette containing the desired data. The planned scaler, or the digitizer are both highly precision scaling devices which when moved over the plan produces data which defines the distance of movement from a beginning point to another point on the plan. Plan scalers of this type are well-known in the industry.

The northing and easting location of each of the points 201 through 238 is entered, by means of a keyboard 116, or any other convenient data entry means, into a relational recorder 114. The relational recorder, which is a typical electronic data processing digital recording system, records for each of the northing and easting points, the lateral coordinates, in terms of the northing and easting and the elevation, and may also include the distance, in the final graded configuration, from one or more other northing and easting points. The distance can be calculated, of course, from the northing and easting data alone. All these data are recorded on the computer diskette, or other data storage means, and define a multiplicity of the predetermined northing and easting points on the tract to be graded by the northing and the easting of the point and also by the target elevation of each such point. Additional data, such as the cross slope of the grade at such point may also be included, or such data may be calculated by comparison of adjacent northing and easting points or computed at job site with unit 120. The data storage means 118 is then introduced into an on-board digital comparator computer, carried by the earth grading machine. The operator of the earth grading machine then drives the earth grading machine to any desired northing and easting points and locates it with the grading tool at the particular point. The location of the grading machine is then fixed relative to one or more reference points. For example, the operator may enter into the digital comparator computer 120, by means of a keyboard, or any other convenient data entry means, the identification of, or definitional data of the particular northing and easting point. Fixing data may be obtained from the location signal generator. It is contemplated that each such point may be given a number or other identifier and upon entry of that identifier all of the encoded data with respect to that point, e.g. the northing location, the easting location and the elevation, and any other data which may be recorded with respect to that point, will be called up from the data storage means. In a simplified manner of operation, the operator will then enter, in a similar manner, the identifier, or the data with respect to another northing and easting point toward which the earth grading machine is to be driven. With these two northing and easting point definitions in memory, the configuration of the tract, in its final target configuration, between the two points is define,, if the grade is in the form of a straight line, i.e., if there is no vertical curvature. However, the digital comparator computer automatically calls into memory all northing and easting points adjacent the two northing and easting points identified by the operator and from a series of two or more northing or easting points, computes the vertical curve to be followed by the grading tool between the two points defined by the operator. The vertical curve may, of course, be flat, a straight cross slope, or the arch of a simple or complex mathematical curve. The curve is calculated as a continuum, i.e., a continuous series of an infinite number of points infinitely close together, each of which is defined as to elevation and northing and easting.

The grading machine may, however, be guided in any direction at any location on the tract. The locational and directional signals and the elevational signals tell the operator or control the machine to adjust the depth and slope of cut to conform to the ultimate configuration or an intermediate configuration if the cut to obtain the ultimate configuration is too deep to be made in one pass.

If, as in the simple example, the grading tool, being located at a predetermined, pre-marked northing and easting point, it is possible for the operator to enter very precisely the actual elevation of the grading blade from the specifications which define the elevation, before grading, at the particular point. This is useful in checking the operation of the system and the progress of the process of the invention, but is inadequate to assure grading to the proper configuration. In order to assure that the proper elevation is maintained, the laser detector 12, through any suitable encoder, generates a signal which defines the actual elevation of the grading tool. The elevational data from the data storage means and the elevational data from the elevational data signal generating means which derives a data signal from the laser detector, defining the actual elevation of the grading tool, are displayed to the operator. The preferable display is a video display of the conventional type, indicated at 130*a* in FIG. 2. The display, in the preferred embodiment, comprises two lines 132 and 134, as depicted in FIG. 2. The line 132 is the target elevation, and the line 134 is the actual elevation of the grading blade. The display may also include a vertical scale, which may be in the form of a pair of lines, which gives a quantitative relationship between the target elevation and the actual elevation of the grading tool, such a scale being indicated at 136 in the display 130*a* of FIG. 2. In the preferred embodiment, a third pair of tolerance indicating lines 138 are also generated from tolerance data indicating the maximum allowable deviation from the actual target elevation. Through output recorded from the cross slope detector actual cross slope can be displayed on the grading tool as well as the target elevation. These tolerance data can be entered by means of the keyboard 116, or other data entry means, or calculated from basic engineering date, into the relational recorder 114, and are recorded along with other data for each northing and easting point or through keyboard 52 to the CPU comparator 120.

By carrying out the process to this point, it is possible for the operator to determine simply by viewing the display 130*a*, how much he should raise or lower the grading tool in order to achieve the target elevation. This, in itself, is a time saving feature of the invention, but the significance of the invention comes into play as the process is carried on during the actual grading of the site. As the grading machine moves from one point to another, as entered by the operator, distance scaler 40, which has been previously described, through an encoder 42, which may be of the type described with respect to encoder 112, adapted to encode the output data from the scaling wheels 40*a* and 40*b*, generate a location data signal, deriving a data signal from the scaling means which defines the actual location of the grading tool relative to the continuum computed by the reference data signal generating means from the data storage means. Thus, at every instant from the time the grading starts at a given, predetermined northing and easting point to the time the grading is completed at any other northing and easting point, the operator simply observes a visual display which is at one in the same time easy to read and to interpret and also defines exactly the elevational relationship of the grading tool to the target elevation and the cross slope cut of the blade as compared with the target cross slope, and thus defines the nature and amount of adjustment needed to bring the grading tool to exactly the target elevation or to within tolerance. In addition, in the preferred embodiment, the allowable tolerances also displayed to inform the operator viewing the display, whether or not the grade to which the grading tool is cutting is within the tolerance allowed and that specific location on the tract. As previously discussed, a split image display or a second display 130*b* may be provided to also tell the operator where he is located with respect to any predefined northing and easting point on the plan view. This is of secondary importance, however, since the operator will be able to locate himself with respect to the predetermined northing and easting points. It is significant to observe at this point that a system which does not permit the operator to visually locate himself, and the location of the grading machine, on the tract, is quite satisfactory. First, engineering plan view will not always inform the operator what obstacles may be on the surface of the ground. In addition, large stones, tree stumps, etc., may be underneath the ground which will require the constant exercise of judgment by the operator. Perhaps more importantly, the operator must be able to discern for himself, by visual observation of grading stakes at the particular northing and easting points exactly where he is to give him the confidence to proceed with the plan. It is, therefore, totally unsatisfactory simply to totally automate a grading system. Total automation, in which the grading tool elevation and tilt is controlled by the digital comparator computer is within the scope of this invention, and may be utilized during the final grading of the tract, once all that is left is minor adjustments of the elevation. This is of secondary importance, however, a system which will only accomplish this would be totally unsatisfactory in most grading operations in which there is any degree of complexity in the beginning contour of the tract or in the final configuration. The present invention may be viewed in terms of a process for grading a tract of earth using a power driven earth grading machine, which comprises a grading tool, and the system as described hereinbefore.

The method of this invention comprises grading earth with a power grading machine which includes a grading tool and carrying out the following steps during such grading:

(a) Entering into a digital electronic computing comparator the location and direction of travel of the grading tool relative to a first predetermined point on the tract of earth to be graded. This may be done by any conventional means, such as a keyboard, or may include deriving a signal from an electronic distance measuring (EDM) system.

(b) Scaling the distance traveled by the grading tool relative to said predetermined point. This scaling is preferably done with one scaling wheel or a pair of tandem mounted scaling wheels which track behind the grading tool. A signal is derived from the scaling wheels, taking the distance travelled by the wheel which at any given locations travels the least distance. A rock or hole will cause the wheels to travel a greater distance than the actual grade, but since the wheels are in tandem mount, only one will engage the rock or hole at any time and, at such time, the signal will be derived from the other wheel, thus eliminating errors in distance scaling.

(c) Deriving from the scaling step a distance signal which defines the distance traveled by the grading tool relative to said predetermined point.

(d) Deriving from laser elevation defining means an actual elevation signal which defines the actual elevation of the grading tool. This step, in isolation from the method as a whole, is well known and conventional in the art.

(e) Optionally deriving from cross slope measuring means associated with the grader blade a cross slope angle signal which defines the angle with respect to horizontal at which the grader blade is positioned and cutting.

(f) Introducing the distance signal and the actual elevation signal into the comparator. If the direction of travel is derived, a direction signal is also introduced into the comparator.

(f) Deriving, in the comparator from data storage means containing a multiplicity of definitions of predetermined points on said tract of earth, the definition of at least one additional predetermined point adjacent the first predetermined point sufficient to define the target configuration of the tract contiguous to the first predetermined point in the direction of travel of the grading tool, each of such predetermined points being defined at least by the coordinate location and elevation, and preferably by angle of cross slope cut, of such point on a tract of earth to be graded. The data storage means is preferably a magnetic tape or disk upon which digital data defining the easting and northing, the elevation, the tolerance and the angle of cross slope angle at the particular point. Other data and identifier information may also be included. Preferably, each point is numbered or given an identifier. The operator simply enters the identifier and the comparator reads all data relative to the predetermined point so identified into the memory of the comparator computer.

(g) Deriving in the comparator a reference elevation signal which defines the target elevation of the tract at the actual location of the grading tool. This target elevation is at any of an infinite number of points on a continuum derived by the comparator and corresponds to the actual location of the tool as calculated in the comparator from data and signals which define the initial location of the grading machine and its direction and distance of travel. The continuum may be a "flat curve", i.e., a flat line either horizontal or cross sloped, or it may be an "arcuate curve" of any shape. "Arcuate" as used here would include circular, elliptical, parabolic and other arcs; i.e., any nonlinear function. The reference signal may also include data defining the inclination of the tract and the desired tilt of the grading tool.

(h) Displaying on visual display means reference elevation indicia derived from the actual elevation signal and the reference elevation signal, said indicia visually, quantitatively relating the actual elevation of the grading tool with the target elevation at the location of the grading tool, whereby the operator of the grading machine can visually determine said relationship and the adjustment necessary to position the grading tool at the target elevation. The preferred form of display is a video screen upon which an index, e.g. a line across the screen, indicates the target elevation and another such index indicates the actual elevation, the two index lines being in a spaced relation having a known ratio to the actual difference between the actual and target elevations. Further indicia are desirable included to display in a quantitative way the ratio referred to. For example, a scale on one side or both may be displayed showing numerically the number of feet or fractions of feet between the actual and target elevations. Another index line is also desirably displayed to indicate, relative to the actual and/or target elevation the tolerance permitted at any given point. This permits the operator to meet specifications without wasting time on insignificant grading corrections.

In one form the method comprises deriving from EDM 60 a position identifier signal defining the position or location of the grader and from the same or a different source 60*a* the direction of travel of the grading machine relative to a predetermined point. From the, elevation signal, position identifier signal, direction identifier signal, and reference data, the comparator derives the location and direction of travel of the grading machine relative to the ultimate slope and elevation of the tract and displays that relationship on a screen. The method may, however, comprise entering data relative to two predetermined points to define the direction of travel of the grading tool.

The method may now be described with reference to FIGS. 3 and 4, as merely exemplary of the kind of application to which the present invention may be put. Referring to FIGS. 3 and 4 together, and, most particularly, to the street at the left hand side of FIG. 3, the elevation of which is shown in FIG. 4, it will be seen that some minimal number or grade stakes indicated by the circles numbered 201, 203, 205, 207, 209 and 210 are necessary to define the edges of the particular building paths. These grade stakes may also define the edge of curving, streets, etc. Additional stakes may also be placed as desired. The reference stakes each have a particular and specifically defined northing and easting location. Each of them also have a specifically defined elevation. The elevation may be set forth on the drawing and/or included in separate specifications. The elevation view taken along lines 44 and shown in FIG. 4 shows the existing grade, which is an irregular dashed line, the target grade for the building pads and the target street grade. The building pads are a series of flat areas connected by cross slopes. The street is defined as a curve, a portion of which is straight and a portion of which is generally arcuate.

The prior art practice required that a plurality of additional stakes, identified by numerals 301 through 316 would be driven in the ground and the operator move the grading tool along at a comparatively slow rate to correspond to the individual stakes. A second man, an assistant, would be required to move along with the grading tool, keep the stakes in their proper stakes and uncovered, and assist in assuring that the grading tool elevation corresponded to the elevation of the grading stakes.

According to the present invention, however, the operator would simply locate the grading tool at any of the reference stakes 201, 203, 205, 207, 209, or 210. The operator would enter into the digital electronic computing comparator the location of this particular predetermined stake. This would be the starting point or the first predetermined point. The direction of the travel also be entered into the comparator. This may be done by a dedicated direction sensing device, by the operator entering a first predetermined point at which the grading tool will start, e.g. .201 and a second, or more than one second additional predetermined point to which the grading tool will be moved, e.g. grading point 203. This defines the beginning and the end of the travel of the grading tool, for that particular cut, and also defines the direction of travel of the grading tool. The entry may typically be made by keyboard in the cab of the grading machine. The direction of travel may also be calculated from a dedicated direction signal generator or from a direction signal derived from one or more distance and/or angle measuring devices on a single point or continuous basis. The grading machine is then caused to move in the direction defined or any selected direction and the distances are scaled from the first predetermined point. As indicated, the scaling may be with the pair of tandem mounted scaling wheels or by any other scaling means. If the wheels as described are used to scale distance, the rotation of the wheels, which move freely along the graded surface, accurately scales the distance. This is not true if scaling is taken from the drive wheels of the grading machine, or even from the guiding wheels of the grading machine, since in both instances the wheels may slip, may travel greater or lesser distances depending on churning, etc.

A signal is derived from the scaling wheels, taking the distance traveled by the wheel which at any given location travels the least distance. It is common that even on the graded surface, particularly in early cuts, a rock may roll into the path of the scaling wheels, a hole may be left, etc. If the scaling wheel drops into a hole and rolls along the bottom of the hole, or if it rolls over a rock, it will travel a greater distance than the level surface. Thus, by selecting the grading wheel which travels the least distance, an accurate scaling of the distance will always be accomplished. If the travel of the grading machine goes past more than one reference point, the scaling can be corrected. For example, if the second predetermined point were point 207, he would simply punch in the location of this predetermined point 203, for example by identifying point 203, and defining data of point 203 would be called up from the data storage mean. By this means, the exact location of the grading tool would be redefined at each subsequent predetermined point of reference. These complications are not faced if EDM or other direction of travel and location signals are used, but at some loss of precision in some cases.

During the course of travel, the actual elevation of the grading tool is defined by deriving an actual elevation signal from the laser elevation defining means. The scaling and actual elevation signals are introduced into the comparator.

The data storage means, typically a floppy disk, includes the identification and definition of at least the northing, easting and elevation of a multiplicity of predetermined points. Preferably, the data storage means also includes the definition of any inclination or tolerance relative to the particular predetermined point. A signal is derived from the data storage means which includes the definition of the first predetermined point 201 and, optionally, of at least one additional predetermined point 203, or a series of additional predetermined points 203, 205, 207, 209, and 210. Using the definitions of these predetermined points, the target configuration of the tract contiguous to the first predetermined point in the direction of travel of the grading tool is thus defined and a signal defining that configuration as a continuum of an infinite number of infinitely close points along a straight or curved path, each of which is defined as to elevation and, if desired, as to tolerance and inclination, is provided as the reference signal. This reference signal is principally an elevational signal, although it may include other information if desired.

By deriving in the comparator a reference elevational signal which defines the target elevation of the tract at the actual location of the grading tool, for example at any arbitrary point between 201 and 203, with the actual elevation of the grading tool, and displaying an index marker showing the relationship of the target elevation to the actual elevation, the operator can determine whether to lift or lower the grading tool. If the tilt or inclination of the grade is also defined, the operator can tilt the grading tool to correspond to the desired inclination.

The preferred method of display is to display reference elevation indicia, which define the target elevation, and actual elevation indicia in a predetermined relationship. The reference elevation indicia is derived from the data storage means in the comparator and the actual elevation indicia is derived from the actual elevation signal. These indicia are displayed as markers or lines on a video display screen. The distance on the display between the lines is in a known ratio to the actual differences between the target elevation and the actual elevation the grading tool. The distance between the indices on the display video screen may be the same as, less than or greater than the actual difference between the actual elevation and the target elevation, and that ratio may be changed by simply electronic switching techniques, which are well known in the art. For example, in early cuts, the display may show two lines, two inches apart indicating that the actual cut is being made two feet from the target elevation. At a later stage in the grading, when the final grading is accomplished, the lines may be two inches apart, indicating that the grading tool is 2/10th's of a foot from the target elevation. In the preferred embodiment, a third line, indicating the tolerance acceptable at the given point is also displayed. For example, if a tolerance of 5/100th's of a foot were permitted, the tolerance lines would be displayed above and below the target elevation index and the actual elevation index would indicate that it the cut is within the tolerance permitted. The lines may be tilted on the display to indicate the target cross slope and the actual cross slope cutting angle of the grader blade, in the same manner, to inform the operator whether or not the cross slope cut is within tolerance.

As the grading machine approaches the predetermined points of reference 207, 209, and 210, the grade of the street is a vertical curve. In the prior art, the technique usually use was to place a great many stakes close together along a chord of the curve and to follow these chords. This approximated the curve and is generally satisfactory, although far from ideal. This is a very time consuming operation, however, and quite expensive. According to the present invention, the arch of the vertical curve is defined by three or more points and an infinite number of intermediate points are calculated in the form of a continuum, i.e., a continuous curve which includes the three points defining the curve. Thus, at any location exact target elevation on the curve is defined and the grading tool can be adjusted to conform exactly to or within the tolerance permitted at the particular point on the curve.

The same concept may be used to define a curve lying on the plane of the tract. For example, the points 209, 210 and 212 define the curve of the street curb. By deriving from the data storage means, the definitions of these three predetermined points 209, 210 and 212, in deriving the curve defined thereby in the lateral plane, the curve of the curb is defined. A signal is derived defining the reference location along a continuum of an infinite number of points on that curve and this signal is displayed as an index line in the preferred embodiment, on the video screen. In this instance, an index line may be on the same or a separate screen and may be a vertical line. Alternatively, the video index may be simply a point which moves along a video displayed plan view of that portion of the plan thus indicating a conformance of the grading tool with the location on the plan. In a preferred embodiment, a second video screen or split image video screen is provided and vertical index lines are displayed on the second display. One index line is reference or target location, the second is the actual location, the distance between them indicating the actual distance of the grading tool from the target location, and the third set of lines indicating the permitted upper and lower tolerances.

In both instances using index lines, it is preferred to display a scale along the side or at the top or bottom of the screen indicating the actual distance represented by the spacing between the index lines.

The process also contemplates the fully automatic operation of the grading machine for certain purposes. For example, using the position locator, EDM or laser system, which locates and defines the position of the grader, in terms, for example, of a given northing and easting coordinate position and derives a direction signal which defines the direction of travel of the grading machine. The signal is encoded and received by the digital comparator computer 120. The digital comparator computer may automatically drive the servo controller 140 which controls both the depth and the cross slope angle of tilt of the blade 32, by conventional hydraulic actuating means 34*a* and 34*b*.

Figure 5:
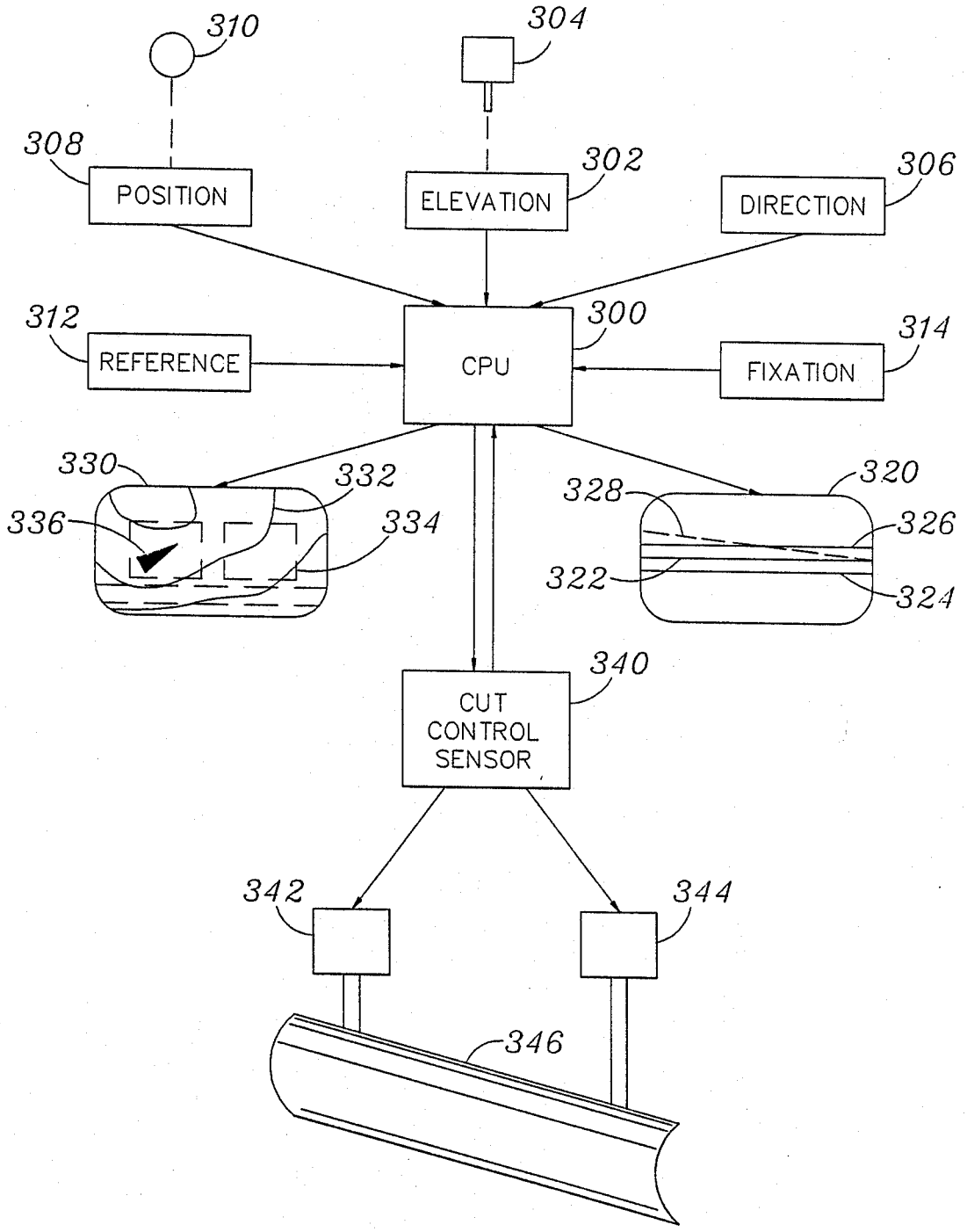
FIG. 5 is a schematic depiction of another embodiment of the system of this invention.

FIG. 5 depicts in a general schematic form a comprehensive system according to the principles of this invention. The general system comprises a CPU 300 which receives the signals from the various signal generating and deriving means and calculates various output signals which are used to drive one or more display devices and/or to control the position and angle of the earth moving blade, including control of the direction of travel of the earth mover and the elevation and angle of the blade on the earth mover. The input signals may be in any form, e.g. analog or digital, although digital signals are most easily accepted and processed without the need for digitizer circuits in the CPU. The CPU may be, for example, a conventional digital processor such as is used in micro and minicomputers along with associated memory devices, e.g. ROM and RAM memory devices of any of a variety of types, power supplies, In and Out (I/0) circuitry, clocks, etc. as are well known in the digital processing arts. The CPU and other instruments carried on the earth mover would differ from other computers principally in that such instruments would have to be shockproof and packaged in dust-proof and waterproof packages to prevent damage from the elements and withstand the physical shock of riding on the earth mover.

The CPU receives an elevation signal from an elevation signal generator 302 which may be of any type. The presently favored type of elevation signal generator is the laser receiver which receives a laser beam from the laser beacon 304, as previously described, for example. The elevation signal generator may, however, comprise a gyroscope or inertial sensor and a signal digitizer.

The CPU receives a direction signal from a direction signal generator 306. The direction signal generator may be a gyroscope or inertial device or a radiation sensing device or scaler wheels. If scaler wheels are used, for example, of simply a drag device, the direction of travel may be determined simply by comparing the angle of the scaler wheel orientation or drag device orientation with a know reference, e.g. a reference line or direction established by a gyroscope. A direction signal my be derived by calculating the angle of travel from a previous location to the present location and comparing that angle with a reference angle or direction. Since an earth moving machine does not normally make extremely sharp turns, the latter method would provide a direction of travel signal which is accurate enough for most applications.

The CPU receives a position signal from a position signal generator 308 which may be of any type. For example, position may be derived from a satellite generated or reflected signal in which case the position would be "absolute" in the sense that reference would be made to a point external of the tract. Position may be derived by reference to a point on or adjacent the tract either in terms of distance or direction or both. An electronic distance measuring device, scaler wheels, or a gyroscopic or inertial, or equivalent, instrument may be used to derive a "comparative" signal in which the location is determined by reference to one or more points on or adjacent the tract being graded. Thus, the unit 310 may be satellite or a reflector against which the infrared radiation of an electronic distance measuring device is bounced. If the scaler wheels, a gyroscope or inertial sensor, or other machine carried device which does not rely upon reflected or received energy or waves is used, then, of course, the unit 310 is not necessary.

Reference data are introduced into the CPU from a reference signal generator 312. While any kind of reference signal generating device may be used, the preferred reference signal generator is a digital data storage unit of any convenient type. For example, a digital memory device such as a tape or disk or nonvolatile solid state memory chip may be used. The reference data includes elevation, distance and slope information for a sufficient number of points on the tract to define the ultimate grading desired and my include additional data defining the depth of the cut at any point, etc. The reference data may be generated in any desired way. For example, digital information defining the parameters of each point may be entered manually by the usual keypunch operation, from a scaler in which a wheel is moved across a scaled drawing and the distances digitized along with keypunch entry of elevation and slope data, from an optical reader which scans either the drawings or specifications of the grading plan, or by direct calculation using a program or manual calculation based upon a mathematical or empirical definition of the starting grade and final grade. The reference data may be received from a large central processing unit in a trailer or other fixed location using conventional digital data radio transmission systems rather than stored on board the earth mover.

An optional feature, which may be very useful in some applications, is a fixation signal generator 314 which allows manual or other entry of data into the CPU defining the absolute or relative location of the earth mover at any point. For example, as a grading project is started, the operator may enter the northing and easting of the earth mover as a beginning reference. During the grading operation, corrections to compensate for accumulated errors may be entered from time to time based upon survey stakes, external signals, or other information sources.

The CPU may generate several output signals. For example, the CPU may generate signals which are displayed in the form of visible indicia on the display monitor 320 in the form of , for example, a reference line 322 representing the slope and elevation of the grade to be cut, lower and upper tolerance lines 324 and 326, and a dashed or other line 328 depicting to scale the elevation and slope of the cutting blade relative to the reference elevation and slope.

The CPU may also generate plat location data for display on a video monitor 330 which would display the data as indicia showing, for example, the contours of the tract before grading by means of contour lines 332, the location of the various pads and roads or other portions of the tract by dashed or other distinct lines 334 and the location and direction of travel of the earth mover on the tract by an arrow or other marker 336.

The CPU may generate control signals which are directed to the cut controller, which may also serve as a slope sensor, indicated at 340, which operates servos or other controllers 342 and 344 to control the slope of the blade 346 which grades the tract. The controller system just described may also serve to generate a signal which is a function of the slope of the blade which is fed to the CPU thus permitting the CPU to generate a signal showing the actual slope of the blade and/or a signal which automatically corrects the slope of the blade. Of course, any other blade slope generator may be used, e.g. the type described previously, a laser detector on one or both ends of the blade and/or a device to measure the angle of the blade from horizontal, etc.

The system as described permits the operator, or any controller, to move the earth mover across the tract in any direction at any point, and to adjust the blade to the proper elevation and slope cutting angle. If the direction of travel of the moving machine changes, then the elevation and/or slope of the blade may be corrected manually or automatically to coincide with the proper elevation and/or slope at the position of the earth mover on the tract. Also, the direction of travel of the earth mover may be changed to accomplish the most efficient movement of earth, e.g. to permit a deeper or shallower cut to be taken to take advantage of the cutting capability of the earth mover without overloading the machine by making too deep a cut. All this can be done fully automatically or manually by an operator who derives his information from monitor 320 and, if desired, from a second monitor 340. In practice, of course, all data may be displayed on a single monitor simply by switching the input. Two monitors would not normally be used, but are shown here simply for convenience in explanation.

One of the features of this invention is that the technology for accomplishing the entire process, and each component of the system, is within the known state of the art. An exemplary plan scaler has been described. A relational recorder may simply be any microcomputer which will record digital data on a diskette or tape, or other digital storage means. A laser beacon and laser detector are of the conventional type described. Distance scalers have been described in some detail. Analog to digital converters are conventional. Gyroscopes and inertial guidance, sensing and control systems are know. Satellite positioning systems are know. The digital comparator computer may simply be any kind of digital data processor device. A properly packaged and programed ordinary personal computer, for example, may serve very adequately as a digital comparator computer. The programs for receiving the various data, making the various comparisons, and deriving the various signals for display and control may be embedded in the hardware of the digital comparator computer, may be in the form of firmware or software. While these programs are tailored to meet the specific application, they may be written in any of the conventional languages by anyone skilled in the art of writing programs. These programs may, for example, be written by any skilled programmer in Fortran, Pascal, Basic, or in assembly language, as may be desired. The writing of the programs, once the concept and instruction of this invention is given, is well within the skill of the art and within the skill of a computer programmer of ordinary ability.

It will also be recognized that within the concept of the invention, there may be many changes and adaptations to meet particular needs or goals. The invention comprises an overall combinational system working together to accomplish a result not heretofore available to the grading art, and a process which accomplishes the grading in a highly efficient manner and with great precision.

INDUSTRIAL APPLICATION

This invention finds direct industrial application in the earth grading and civil engineering.

What is claimed is:

1. An earth grading system for grading a tract of land, comprising, in combination:

(a) a power driven earth grading machine which comprises a frame, an earth grading too, and means for adjusting the earth grading tool relative to the frame;

(b) a laser beam generator remote from said earth grading machine for projecting a laser beam in a predetermined pattern relative to the earth to be graded;

(c) a laser detector carried on the grading machine for receiving the laser beam;

(d) distance scaling means for accurately scaling the distance of the grading tool from a predetermined northing and easting point on the tract to be graded;

(e) data storage means defining a multiplicity of predetermined points on the tract of land to be graded by the northing and easting of the point and by the target elevation of such point;

(f) reference data signal generating means for deriving a data signal from the data storage means which defines the desired final graded configuration of a continuous portion of the tract by a continuum computed with reference to at least two of the aforesiad predetermined points, all locations on the continuum being defined as to target elevation;

(g) elevation data signal generating means for deriving a data signal from the laser detector which defines the actual elevation of the grading tool;

(h) location data signal generating means for deriving a data signal from the scaling means which defines the actual location of the grading tool relative to the continuum computed by the reference data signal generating means; and (i) comparator means for receiving the aforesaid data signals and for deriving at least one output signal which defines the elevational relationship of the grading tool relative to target elevation at the actual location of the grading tool on the continuum.

2. The earth grading system of claim 1 wherein the comparator comprises means on the earth grading machine for enabling an operator to enter data defining the actual location of the earth grading tool, and means in the comparator for processing such actual location data along with the aforesaid data signals in deriving the aforesaid output signal.

3. The earth grading signal of claim 2 wherein the data storage means defines the allowable elevation tolerance at the predetermined points, and wherein the comparator comprises means for deriving in the output a signal relating the elevational tolerance to the actual elevation of the grading tool.

4. The earth grading system of claim 1 wherein the data storage means defines the allowable elevation tolerance at the predetermined points, and wherein the comparator composers means for deriving a comparator output signal relating the elevational tolerance to the actual elevation of the grading tool, and wherein the system further comprises display means for receiving the comparator output signal and displaying visual indicia on a scaled display depicted according to a predetermined ratio the target elevation, allowable elevations which are within tolerance, and the actual elevation of the grading tool at the location of the grading tool along the continuum to thereby enable an operator to view the display and adjust the elevation of the grading tool to within the tolerance displayed.

5. The earth grading system of claim 4 wherein the comparator comprises means on the earth grading machine for enabling an operator to enter data defining the actual location of the earth grading tool, and means in the comparator for processing such actual location data along with the aforesaid data signals in deriving the aforesaid output signal.

6. The earthy grading system of claim 1 wherein the data storage means defines the allowable elevation tolerance at the predetermined points, and wherein the comparator comprises means for deriving a comparator output signal relating the elevational tolerance to the actual elevation of the grading tool, and wherein the system further comprises display means for receiving the comparator output signal and displaying visual indicia on a scaled display depicted according to a predetermined ratio the target elevation, allowable elevations which are within tolerance, and the actual elevation of the grading tool at the location of the grading tool along the continuum, and means for automatically adjusting the elevation of the grading tool to within the tolerance displayed.

7. The earth grading system of claim 6 wherein the comparator comprises means on the earth grading machine for enabling an operator to enter data defining the actual location of the earth grading tool, and means in the comparator for processing such actual location data along with the aforesaid data signals in deriving the aforesaid output signal.

8. An earth grading system for grading a tract of land, comprising in combination:

(a) a power driven earth grading machine which comprises a frame, an earth grading tool, and means for adjusting the earth grading tool relative to the frame;

(b) a laser beam generator remote from said earth grading machine for projecting a laser beam in a predetermined pattern relative to the earth to be graded;

(c) a laser detector carried on the grading machine for receiving the laser beam;

(d) distance scaling means comprising a pair of tandems scaling wheels mounted to the frame for tracking on the graded earth behind the grading tool for accurately scaling the distance of the grading tool from a predetermined northing and easting point on the tract of land to be graded;

(e) data storage means defining a multiplicity of predetermined points on the tract of land to be graded by the northing and easting of the point and by the target elevation of such point and further defining the elevational tolerance at such point;

(f) reference data signal generating means for deriving a data signal from the data storage means which defines the desired final graded configuration and the elevational tolerance of a continuous portion of the tract by a continuum computed with reference to at least two of the aforesaid predetermined points, all locations on the continuum being defined as to target elevation;

(g) elevation data signal generating means for deriving a data signal from the laser detector which defines the actual elevation of the grading tool;

(h) cross slope angle signal generating means for deriving a signal which defines the angle of cut of the grader blade;

(h) location data signal generating means for deriving a data signal from the scaling means which defines the actual location of the grading tool relative to the continuum computed by the reference data signal generating means;

(i) comparator means for receiving the aforesaid data signals and for deriving a first comparator output signal which defines the elevational relationship of the grading tool relative to the target elevation and elevational tolerance at the actual location of the grading tool on the continuum and a second comparator output signal which compares the actual cross slope angle with the target cross slope angle, and optionally including means for enabling an operator to enter data defining the actual location of the grading tool on said continuum and means for deriving in the first output a signal relating the elevational tolerance to the actual elevation of the grading tool; and (j) display means for receiving the first and second comparator output signals and displaying visual indicia on a scaled display depicted according to a predetermined ratio the target elevation, allowable elevations which are within tolerance, and the actual elevation of the grading tool at the location of the grading tool along the continuum.

9. The earth grading system of claim 8 further comprising means for automatically adjusting the elevation of the grading tool to within the tolerance displayed.

10. An earth grading system for grading a tract of land, comprising in combination:

(a) a power driven earth grading machine which comprises a frame, an earth grading tool, and means for adjusting the earth grading tool relative to the frame;

(b) a laser beam generator remote from said earth grading machine for projecting a laser beam in a predetermined pattern relative to the tract of land to be graded;

(c) a laser detector carried on the grading machine for receiving the laser beam;

(d) distance scaling means for accurately scaling the distance of the grading tool from a predetermined northing and easting point on the tract of land to be graded;

(e) data storage means defining a multiplicity of predetermined points on the tract to be graded by the northing and easting of the point and by the target elevation of such point;

(f) reference data signal generating means for deriving a data signal from the data storage means which defines the desired final graded configuration of a continuous portion of the tract by a continuum computed with reference to at least two of the aforesaid predetermined points, all locations on the continuum being defined as to target elevations;

(g) elevation data signal generating means for deriving a data signal from the laser detector which defines the actual elevation of the grading tool;

(h) location data signal generating means for deriving a data signal from the scaling means which defines the actual location of the grading tool relative to the continuum computed by the reference data signal generating means;

(i) comparator means for receiving the aforesaid data signals and for deriving at least one comparator output signal which defines the elevational relationship of the grading tool relative to the target elevation at the actual location of the grading tool on the continuum;

(j) display means for receiving said comparator output signal and displaying visual indicia on a scaled display depicted according to a predetermined ratio the target elevation and the actual elevation of the grading tool at the location of the grading tool along the grading continuum to thereby enable an operator to view the display and adjust the elevation of the grading tool.

11. The earth grading system of claim 10 wherein the location data signal generating means comprises means generating two signals, and wherein the comparator uses the signal related to the smallest distance travelled by either of the scaling wheels in deriving the output signal.

12. The earth grading system of claim 10 further comprising means associated with the grader blade for deriving a signal which is a function of the cross slope angle of the grader blade and means for comparing the actual cross slope angle with the target cross slope angle and displaying at least two lines on a video screen which depict a comparison of the actual cross slope angle with the target cross slope angle.

13. The earth grading system of claim 10 further comprising means for deriving a position signal which defines the position of the grader on the tract to be graded and means for deriving from said position signal and from target data the blade location which is required to configure the tract at said position to comply with the target configuration criteria at said position and for displaying indicia permitting visual comparison of actual blade location and orientation with target blade location and orientation.

14. The earth grading system of claim 10 further comprising:

(k) adjusting means for receiving the output signal and in response thereto automatically adjusting the grading tool to a predetermined elevation relative to the target location at all locations along the continuum.

15. The earth grading system of claim 14 wherein the location data signal generating means comprises at least one disk, means rotating the disk in proportion to the rotation of the scaling wheels indicia on the disk and sensing means generating a signal as each index of the disk passes the sensing means.

16. The earth grading system of claim 15 wherein the location data signal generating means comprises means generating two signals, and wherein the comparator uses the signal related to the smallest distance travelled by either of the scaling wheels in deriving the output signal.

17. The earth grading system of claim 16 further comprising means associated with the grader blade for deriving a signal which is a function of the cross slope angle of the grader blade and means for comparing the actual cross slope angle with the target cross slope angle and displaying at least two lines on a video screen which depict a comparison of the actual cross slope angle with the target cross slope angle.

18. The method of claim 16 wherein step (g) comprises displaying an actual elevation index and a target elevation index on a video displaying screen in spatial relationship having a know n ratio to the actual difference between the actual elevation of the grading tool and the target elevation, whereby the operator can determine by visual observation of the spatial relationship of the indicia the adjustment needed to make the actual elevation coincide with the target elevation.

19. The earth grading system of claim 10 wherein the comparator comprises means for deriving a curved continuum defined by at least three of said predetermined points, saids continuum defining an elevational curve in the vertical plane relative to the tract, whereby the portion of the tract defined by said points is graded along a vertical curve as the grading tool follows the continuum derived by the comparator.

20. The method of grading earth with a power grading machine which includes a grading tool comprising the steps of (a) entering into a digital electronic computing comparator the location and direction of travel of the grading tool relative to a first predetermined point on the tract of earth to be graded;
(b) scaling the distance traveled by the grading tool relative to said predetermined point;
(c) deriving from the scaling step a distance signal which defines the distance traveled by the grading tool relative to said predetermined point;
(d) receiving a laser signal which defines a predetermined elevation and deriving from said predetermined elevation an actual elevation signal which defines the actual elevation of the grading tool;
(e) introducing the distance signal and the actual elevation signal into the comparator;
(f) deriving in the comparator from data storage means containing a multiplicity of definitions of predetermined points on said tract of earth, the definition of at least one additional predetermined point adjacent the first predetermined point sufficient to define the target configuration of the tract contiguous to the first predetermined point in the direction of travel of the grading tool, each of such predetermined points being defined at least by the coordinate location and elevation of such point on a tract of earth to be graded;
(g) deriving in the comparator a reference elevation signal which defines the target elevation of the tract at the actual location of the grading tool; and
(h) displaying on visual display means reference elevation indicia and actual elevation indicia derived from the actual elevation signal and the reference elevation signal, said indicia visually and quantitatively relating the actual elevation of the grading tool with the target elevation at the location of the grading tool, whereby the operator of the grading machine can visually determine said relationship and the adjustment necessary to position the grading tool at the target elevation.

21. The method of claim 20 wherein step (a) comprises entering by data entry means on the grading machine data identifying the predetermined point, and wherein the data storage means of step (f) contains the coordinate and elevational definitions of each predetermined point.

22. The method of claim 20 wherein step (b) comprises the step of moving a pair of tandem scaling wheels behind the grading tool and step (c) comprises deriving the distance signal from the scaling wheel which, in any given areas of travel, travels the least distance, thereby eliminating errors due to irregularities in the graded surface.

23. The method of claim 20 wherein step (f) comprises deriving the definitions of at least two additional predetermined points to define a target configuration having a vertical arcuate curvature and step (g) comprises deriving a reference elevation signal which defines the target elevation on said vertical arcuately curved target configuration.

24. The method of claim 20 wherein step (g) further comprises displaying a scale adjacent the indicia quantitatively defining the actual distance between the actual and target elevations.

25. The method of claim 19 wherein step (g) further comprises displaying a tolerance index spatially related to the target elevation index and the actual elevation index in a known quantitative relationship, whereby the operator can determine by visual inspection of the display whether or not the actual elevation is within the tolerance permitted at the actual location of the grading tool on the tract.

26. The method of claim 20 wherein step (a) comprises entering by data entry means on the grading machine data identifying the predetermined point, and wherein the data storage means of step (f) contains the coordinate and elevational definitions of each predetermined point.

27. The method of claim 20 wherein step (b) comprises the step of moving a pair of tandem scaling wheels behind the grading tool and step (c) comprises deriving the distance signal from the scaling wheel which, in any given area of travel, travels the least distance, thereby eliminating errors due to irregularities in the graded surface.

28. The method of claim 20 wherein step (g) further comprises displaying a tolerance line above and below the indicia quantitatively defining the actual distance between the actual and target elevations.

29. The method of claim 28 wherein step (g) further comprises displaying a tolerance index spatially related to the target elevation index and the actual elevation index in a known quantitative relationship, whereby the operator can determine by visual inspection of the display whether or not the actual elevation is within the tolerance permitted at the actual location of the grading tool on the tract.

30. The method of claim 20 wherein step (g) comprises displaying an actual elevation index and a target elevation index on a vide display screen in spatial relationship having a known ratio to the actual difference between the actual elevation of the grading tool and the target elevation, whereby the operator can determine by visual observation of the spatial relationship of the indicia the adjustment needed to make the actual elevation coincide with the target elevation.

31. The method of claim 30 wherein step (a) comprises entering by data entry means on the grading machine data identifying the predetermined point, and wherein the data storage means of step (f) contains the coordinate and elevational definitions of each predetermined point.

32. The method of claim 30 wherein step (b) comprises the step of moving a pair of tandem scaling wheels across behind the grading tool and step (c) comprises deriving the distance signal from the scaling wheel which, in any given area of travel, travels the least distance, thereby eliminating errors due to irregularities in the graded surface.

33. The method of claim 30 further comprising, deriving a position signal defining the position and direction of travel of the grading machine relative to said first predetermined point, introducing the position signal into the comparator and deriving in the comparator from said direction signal the target configuration of the tract in the direction of travel of the grading machine contiguous to the first predetermined point.

34. The method of claim 30 wherein step (a) comprises entering data relative to two predetermined points to define the direction of travel of the grading tool

35. The method of claim 20 wherein step (a) comprises entering data relative to two predetermined points to define the direction of travel of the grading tool.

36. The method of grading a tract of earth with a power grading machine which includes a grading tool to achieve a predetermined target configuration for said tract, comprising the steps of:

(a) entering into a digital electronic computing comparator the location of the grading tool relative to a first predetermined point on the tract of earth to be graded;

(b) scaling the distance traveled by the grading tool relative to said predetermined point;

(c) deriving from the scaling step a distance signal which defines the distance traveled by the grading tool relative to said predetermined point;

(d) deriving from elevation defining means an actual elevation signal which defines the actual elevation of the grading tool.

(e) deriving a position signal defining the position of the grading machine relative to said first predetermined point;

(f) deriving a cross slope angle signal defining the angle of the grader blade;

(f) introducing the distance signal, the direction signal, the cross slop angle signal and the actual elevation signal into the comparator;

(g) deriving, in the comparator from data storage means containing a multiplicity of definitions of predetermined points on said tract of earth, the definition of at least one additional predetermined point adjacent the first predetermined point sufficient to define the target configuration of the tract contiguous to the first predetermined point in the direction of travel of the grading tool, each of such predetermined points being defined at least by the coordinate location and elevation of such point on a tract of earth to be graded;

(h) deriving in the comparator a reference elevation signal which defines the target elevation of the tract at the actual location of the grading tool; and (i) displaying on visual display means reference elevation indicia and actual elevation indicia derived from the actual elevation signal and the reference elevation signal, and actual and target cross slope angle indicia, said indicia visually, quantititatively relating the actual elevation and cross slope angle of the grading tool with the target elevation and cross slope angle at the location of the grading tool, whereby the operator of the grading machine can visually determine said relationships and the adjustment necessary to position the grading tool at the target elevation.

37. The method of claim 36 wherein step (i) comprises displaying an actual elevation index and a target elevation index on a video display screen in by lines having a spacial relationship having a known ratio to the actual difference between the actual elevation and cross slope of the grading tool and the target elevation and cross slope, whereby the operator can determine by visual observation of the spatial relationship of the indicia the adjustment needed to make the actual elevation coincide with the target elevation and the actual cross slope angle coincide with the target cross slope angle.

38. The method of grading a tract of earth with a power grading machine which includes a grading tool to achieve a predetermined target configuration for said tract, comprising the steps of (a) entering into a digital electronic computing comparator the location of the grading tool relative to a first predetermined point on the tract of earth to be graded;

(b) scaling the distance traveled by the grading tool relative to said predetermined point;

(c) deriving from the scaling step a distance signal which defines the distance traveled by the grading tool relative to said predetermined point;

(d) deriving from elevation defining means an actual elevation signal which defines the actual elevation of the grading tool;

(e) deriving from direction signal defining means an actual direction of travel signal which defines the direction of travel of the grading machine relative to aids first predetermined point;

(f) introducing the distance signal, the direction signal and the actual elevation signal into the comparator;

(g) deriving, the comparator from data storage means containing a multiplicity of definitions of predetermined points on said tract of earth, the definition of at least one additional predetermined point adjacent the first predetermined point sufficient to define the target configuration of the tract contiguous to the first predetermined point in the direction of travel of the grading tool, each of such predetermined points being defined at least by the coordinate location and elevation of such point on a tract of earth to be graded;

(h) deriving in the comparator a reference curve signal which defines a predetermined target curve of a portion of the tract at the actual location of the grading tool; and (i) displaying on visual display means reference location indicia and actual location indicia derived from the actual direction signal and the reference curve signal, said indicia visually, quantitatively relating the actual location of the grading tool with the target curve at the location of the grading tool, whereby the operator of the grading machine can visually determine said relationship and the adjustment necessary to position the grading tool at the target curve.

39. The method of claim 38 wherein step (i) comprises displaying an actual location index and a target curve index on a video display screen in spatial relationship having a known ratio to the actual difference between the actual location of the grading tool and the target curve, whereby the operator can determine by visual observation of the spatial relationship of the indicia the adjustment needed to make the actual location coincide with the target curve system.

40. An earth grading system for grading a tract of land, comprising, in combination:

(a) a power driven earth grading machine which comprises a frame, an earth grading tool, and means for adjusting the earth grading tool relative to the frame;

(b) an elevation signal generator remote from said earth grading machine for projecting a laser beam in a predetermined pattern relative to the elevation of earth to be graded;

(c) an elevation signal detector carried on the grading machine for receiving the laser beam;

(d) distance scaling means for accurately scaling the distance of the grading tool from a predetermined northing and easting point on the tract of land to be graded;

(e) direction signal generator means for projecting a beam across the tract to be graded;

(f) direction signal detecting means for generating a signal defining the direction of travel of the grading machine;

(g) position signal generator means for projecting a beam across the tract to be graded;

(h) position signal detecting means for generating a signal defining the position on the tract of the grading machine;

(f) data storage means defining a multiplicity of predetermined points on the tract to be graded by the northing and easting of the point and by the target elevation of such point;

(g) reference data signal generating means for deriving a data signal form the data storage means which defines the desired final graded configuration of a continuous portion of the tract by a continuum computed with reference to at least two of the aforesaid predetermined points, all locations on the continuum being defined as to target elevations;

(h) elevation data signal generating means for deriving a data signal from the laser detector which defines the actual elevation of the grading tool;

(i) location data signal generating means for deriving a data signal from the scaling means which defines the actual location of the grading tool relative to the continuum computed by the reference data signal generating means;

(j) comparator means for receiving the aforesaid data signals and for deriving at least one output signal which defines the elevational relationship of the grading tool relative to the target elevation at the actual location of the grading tool on the continuum;

(k) display means for receiving the output signal and displaying visual indicia on a scaled display depicting according to a predetermined ratio the target elevation and the actual elevation of the grading tool at the location of the grading tool along the grading continuum to thereby enable an operator to view the display and adjust the elevation of the grading tool.

* * * * *